US005608961A

United States Patent [19]

Piegeler

[11] Patent Number: 5,608,961

[45] Date of Patent: Mar. 11, 1997

[54] PROCESS FOR MAKING A LOOM HARNESS

[75] Inventor: Gerd Piegeler, Haan, Germany

[73] Assignee: Schroers-Jacquard-Papieindustrie GmbH & Co., Germany

[21] Appl. No.: 430,748

[22] Filed: Apr. 28, 1995

Related U.S. Application Data

[63] Continuation of Ser. No. 98,437, Jul. 28, 1993, abandoned, which is a continuation-in-part of Ser. No. 741,107, Aug. 6, 1991, abandoned.

[30] Foreign Application Priority Data

Aug. 24, 1990 [DE] Germany ..... 40 26 815.2
Oct. 5, 1990 [DE] Germany ..... 40 31 515.0

[51] Int. Cl.[6] ..... B21D 39/00; D03C 3/24

[52] U.S. Cl. ..... 29/452; 29/467; 29/468; 29/469; 139/85

[58] Field of Search ..... 29/452, 467, 468, 29/469; 139/85

[56] References Cited

U.S. PATENT DOCUMENTS 2,705,375 4/1955 Foreman et al. ..... 29/467 X

*Primary Examiner*—Joseph M. Gorski
*Attorney, Agent, or Firm*—Mason, Kolehmainen, Rathburn & Wyss

[57] ABSTRACT

A process for making a loom harness provides for complete prefabrication of a plurality of subassemblies for an entire harness cord assembly as well as enabling the assembly process to move in one direction only rather than two. Each subassembly includes a frame hook, a counterpull element and a heald secured to a flexible harness cord. Connection is made between a bundle of harness cords and a carabiner hook of a Jacquard machine while mails of the healds are maintained at a defined height during an equalization process for insuring the right amount of tautness on each individual harness cord.

7 Claims, 6 Drawing Sheets

PROCESS FOR MAKING A LOOM HARNESS

RELATED APPLICATION

This application is a continuation of application Ser. No. 08/098,437, filed and now abandoned, which is a continuation-in-part of application Ser. No. 07/741,107, filed Aug. 6, 1991 and now abandoned.

BACKGROUND OF THE INVENTION

In one form of a prior process for making a loom harness, the harness is produced by assembling together a large number of separate individual portions or components. For example, a Jacquard type weaving machine can have a large number of carabiner hooks, each acting as a lifting mechanism for a loom harness connected thereto. Commonly, Jacquard machines may have 600 to 8000 lift hooks which are computer controlled to move up and down at the proper time to effect the weaving operation on the loom below. Starting, for example, from a Jacquard machine, the harness forming process begins by connecting a plurality of flexible harness cords to a carabiner hook, snap hook or the like on the Jacquard machine and then drawing the flexible cords downwardly through a single aperture provided in an upper aperture board of a loom harness assembly. Each harness cord is separated from the others and passed further downwardly through a selected opening provided in a comber board having a plurality of spaced apart openings therein. The individual harness cords are thus maintained at spaced intervals apart from one another and hang downwardly from the comber board. A typical harness board may have several thousand openings therein.

Thereafter, the harness making process involves assembling a separate subassembly to each dangling harness cord, each subassembly including a lower frame hook for connection to a fixed frame of the loom, a counterpull element or spring connected thereto and a heald connected between the spring and an individual harness cord hanging down from the comber board.

The operation of connecting thousands of harness cords hanging downwardly from a comber board to a corresponding number of healds which are pulled upwardly from a fixed counterpull frame below is especially difficult, because it is important for a mail or eye of each heald to be brought precisely to a defined height or level relative to the frame or the comber board before the final connection between the heald and the harness cord is secured. The operation of bringing the mails or eyes to a specific height is often referred to as equalization; and in the past, leveling all of the mails or eyes in a loom harness assembly at a selected level was done mainly by eyeballing alone. The terms mails and eyes will be used generally interchangeably in this specification.

To make a loom harness, a separate upper harness element and a separate lower harness element are each partially prefabricated. Then, as described above, the separate harness elements are worked together towards each other for interconnection at a junction region defined between a respective harness cord and a heald. However, this operating procedure suffers from the principal disadvantage in that the point of connection between a respective individual harness cord and a respective heald must be made simultaneously with an equalization operation, which is often difficult to achieve in an effective manner that assures that the mails or eyes are at a precise height.

OBJECTS OF THE INVENTION

An object of the present invention is to provide a process for prefabrication of a complete loom harness subassembly while also simplifying the equalization operation with respect thereto.

Another object of the present invention is to provide a process for making a loom harness which involves a rational procedure involving a simplified mode of operation while ensuring improved results.

BRIEF SUMMARY OF THE INVENTION

In accordance with the foregoing and other objects of the present invention, a process for making a loom harness comprises prefabrication of a plurality of loom harness subassemblies, each having a lower-end, a frame hook and finishing at an upper end with a harness cord adapted to be attached to a carabiner hook or snap hook of a Jacquard machine. Each subassembly also includes a counterpull element or spring, a heald having a mail therein and a flexible harness cord attached to the heald. A common connecting element may be employed for connection of the upper end of a plurality of flexible harness cords to a single carabiner hook or snap hook of a Jacquard machine.

As will be seen in greater detail hereinafter, the process of the invention provides a plurality of prefabricated harness cord subassemblies, each being worked upwardly from a lower level with a first step being that of engaging a lower hook to a fixed frame. Mails on each heald for all of the respective subassemblies are fixed at a defined height above the frame simultaneously with an equalization operation in which the individual harness cords are bundled together above a comber board and drawn upwardly for eventual connection to a carabiner hook of a Jacquard machine.

In one embodiment of the invention all of the mails of a complete loom harness are maintained at the same height or level by means of a bar, mandrel or alignment pins while tautness on the respective harness cords is completed. In another embodiment, thickened portions of each subassembly between a heald and a flexible harness cord thereof are stopped at the same level by engagement against the underside of the comber board moved to an assembly position during the equalization process.

It is essential in the indirect process wherein the thickened portions are engaged with the comber board as stops that the distance or interval between the mail and associated thickened portion of each subassembly be precisely the same for all of the subassemblies of the loom harness.

Each individual prefabricated harness cord subassembly includes a harness cord at the upper end which is pulled upwardly from below through a selected one of many apertures provided in a comber board. All of the cords of a particular loom harness are then bundled together and drawn upwardly through a single opening provided in an aperture board spaced above the comber board. A multiplicity or group of harness cords of a loom harness are thus passed in unison through a single opening in the aperture board and are secured together while in a desired state of equalization and tautness to a single connector or the like, eventually to be attached to a carabiner or snap hook of a Jacquard machine.

The process, in accordance with the principles of the present invention, enjoys advantages in that each individual harness cord subassembly may be completely prefabricated. Moreover, installation of a prefabricated subassembly is started from one side of the loom harness assembly working toward the other side, that is to say in one direction only (rather than both directions as in the prior art), starting from a lower end and moving upwardly therefrom. The equalization operation for all subassemblies can be simultaneously completed at the same time as all of the groups of harness cords of a particular loom harness are secured to individual connectors adapted to be connected to carabiner hooks or snap hooks of a Jacquard machine. Final connection of all of the harness cords of each group is thus completed at one time with each cord having a desired amount of tautness. The associated mails for each heald, including all the mails of the loom harness, are precisely fixed at the same level which completes the equalization operation.

Further preferred features and configurations of the invention are set forth in further claims herein.

Further objects, features and advantages of the present invention will be apparent from the following description of preferred embodiments.

DETAILED DESCRIPTION OF THE PREFERRED EMBODIMENTS

Figure 1:
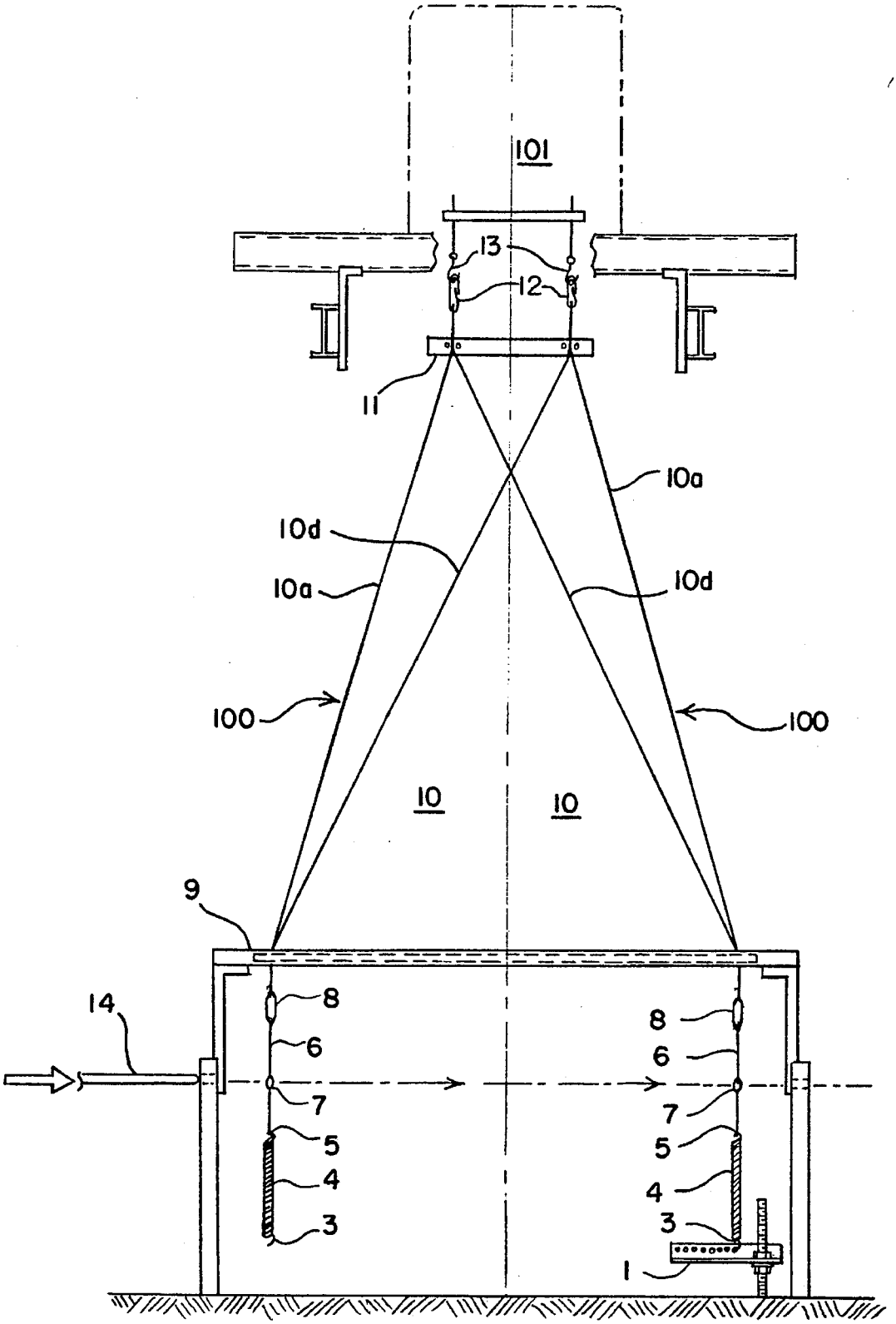
FIG. 1 is a diagrammatic transverse cross-sectional view of a Jacquard machine above a loom including a section of a loom harness made in accordance with the present invention.
Figure 4A:
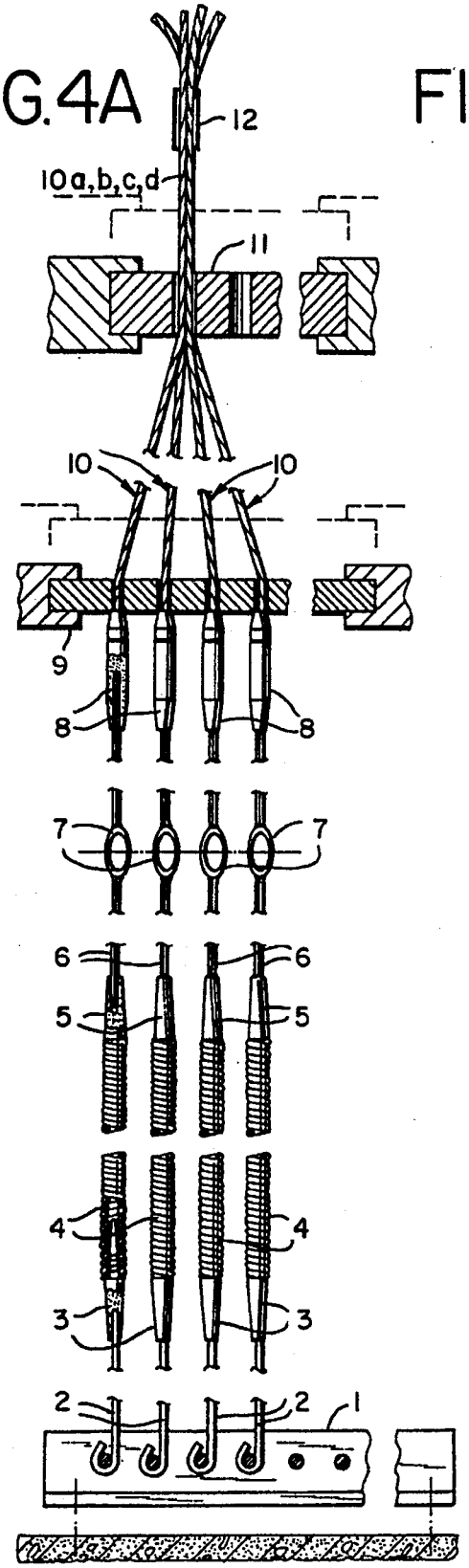
FIG. 4A is a fragmentary enlarged elevational view similar to FIG. 3 of a loom harness made in accordance with the process of the present invention illustrating an aperture board and comber board in an assembly position and a normal operating position is indicated in dotted lines.

Referring firstly to FIG. 1, a new and improved loom harness 100 constructed in accordance with the present invention includes a plurality of harness cord subassemblies 10 (FIG. 4A), each being interconnected between a frame member 1 at the lower end and a carabiner hook or snap hook 13 of a Jacquard machine 101 at the upper end. The frame 1 includes openings adapted to secure a plurality of frame hooks 2 at spaced apart intervals thereon, and these hooks comprise the lowest component of the prefabricated harness cord subassemblies 10.

Reference numeral 3 indicates a connecting element or link which serves to connect a frame hook 2 to a counterpull element or spring 4. Each spring 4 is in turn connected at its upper end by way of a connecting element 5 to a heald indicated at 6. Each heald 6 has a mail or eye 7; and at the upper end, the heald 6 is connected by way of a connecting element 8 comprising a thickened portion to the lower end of a respective flexible harness cord 10*a*, 10*b*, 10*c*, 10*d*, etc.

Each flexible harness cord 10*a*, 10*b*, 10*c*, 10*d*, etc. is passed upwardly through a selected one of a plurality of spaced-apart holes provided in an elongated comber board 9. The comber board 9 may have multiple spaced apart holes and may have a large number of holes, i.e., 10,000. It will be appreciated that the completed loom harness assembly 100 correspondingly has a number of harness cord subassemblies 10 that matches the number of holes utilized in the comber board 9.

All of the individual harness cords 10*a*, 10*b*, 10*c*, 10*d*, etc. are then bundled together and collectively are passed through a single hole provided in an aperture board indicated at 11. Upper end portions of the bundled together cords are secured by way of a connecting element 12 (which may be in the form of a hook, for example) to a single carabiner or snap hook 13 of the Jacquard machine 101 arranged above the loom as shown in FIG. 1.

Figure 4B:
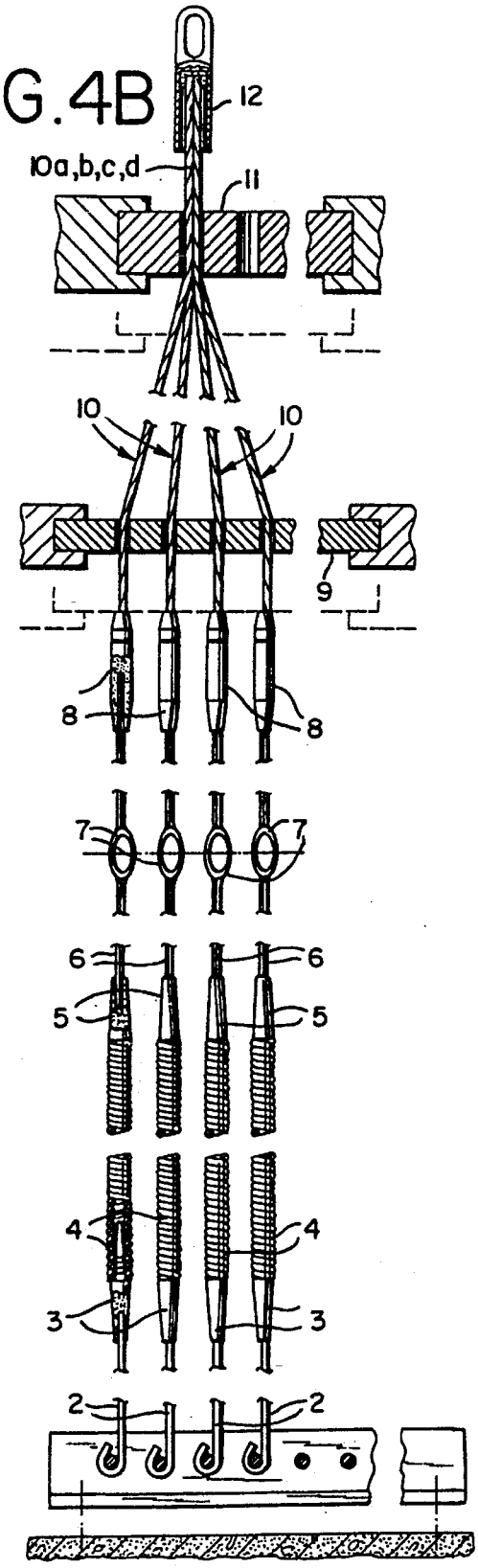
FIG. 4B is a fragmentary enlarged elevational view of the loom harness of FIG. 4*a* illustrating the loom harness thereof in a normal operating position and an assembly position is indicated in dotted lines.

In accordance with the invention, the individual harness cord subassemblies 10 are completely prefabricated (FIGS. 4A and 4B) and more specifically, each subassembly includes a frame hook 2, a connector 3, a counterpull element or spring 4, a heald 6 having a mail or eye 7 at an appropriate level above the frame 1. The upper end portion of each heald 6 is connected to the lower end of an individual harness cord 10*a*, 10*b*, 10*c*, 10*d*, etc. by means of connector 8 taking the form of a thickened portion that is too large to pass through the holes in the comber board 9. The individual harness cords 10*a*, 10*b*, 10*c* and 10*d* of each harness cord subassembly 10 are grouped or bundled together at a level above the comber board 9 and are passed upwardly as a group or bundle through a common single aperture provided in the aperture board 11 before being secured to a connecting element 12.

In accordance with the process of the present invention, tautness of all of the cords 10*a*, 10*b*, 10*c*, 10*d*, etc. of a loom harness is accomplished whereby the height or level of all of the heald mails 7 in each loom harness subassembly 10 is maintained equal to all others. At the same time, the bundled together harness cords 10*a*, 10*b*, 10*c*, 10*d* are secured to the connector 12, thereby providing a suitable degree of tautness on each of the respective individual harness cords 10*a*, 10*b*, 10*c*, 10*d*, etc. attached to a carabiner hook 13 to which a harness cord subassembly 10 is to be connected. The individual cords of each harness cord subassembly or group 10 are thus set to a desired degree of tautness during an equalization operation simultaneously as the final connection of the connector 12 to the carabiner hook 13 is completed. This insures that all of the mails 7 of each group are maintained at the same level as the carabiner or lift hooks 13 move up and down during a weaving operation.

Figure 2:
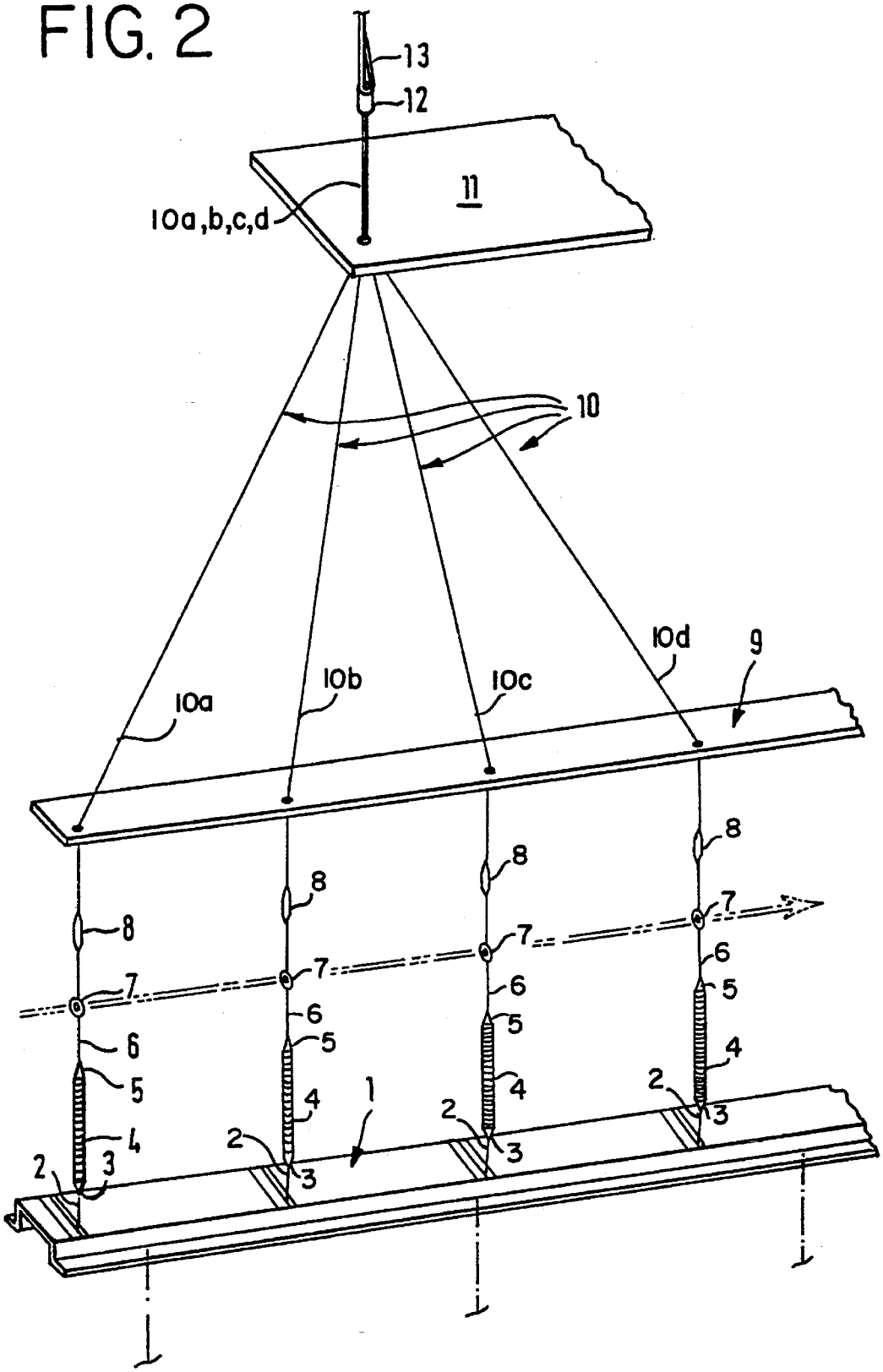
FIG. 2 is a diagrammatic perspective view of a portion of a loom harness constructed in accordance with the present invention and shown with an aperture board and comber board in a normal or customary operating position.

In order to maintain all the mails 7 at the same level during the equalization and the cord connection process, the mails 7 may be held in position by a common mandrel 14 extended therethrough as illustrated in FIGS. 1 and 2. In this direct method of assembly the comber board 9 and aperture board 11 do not need to be moved away from their normal operating position as best shown in FIG. 2.

Figure 6:
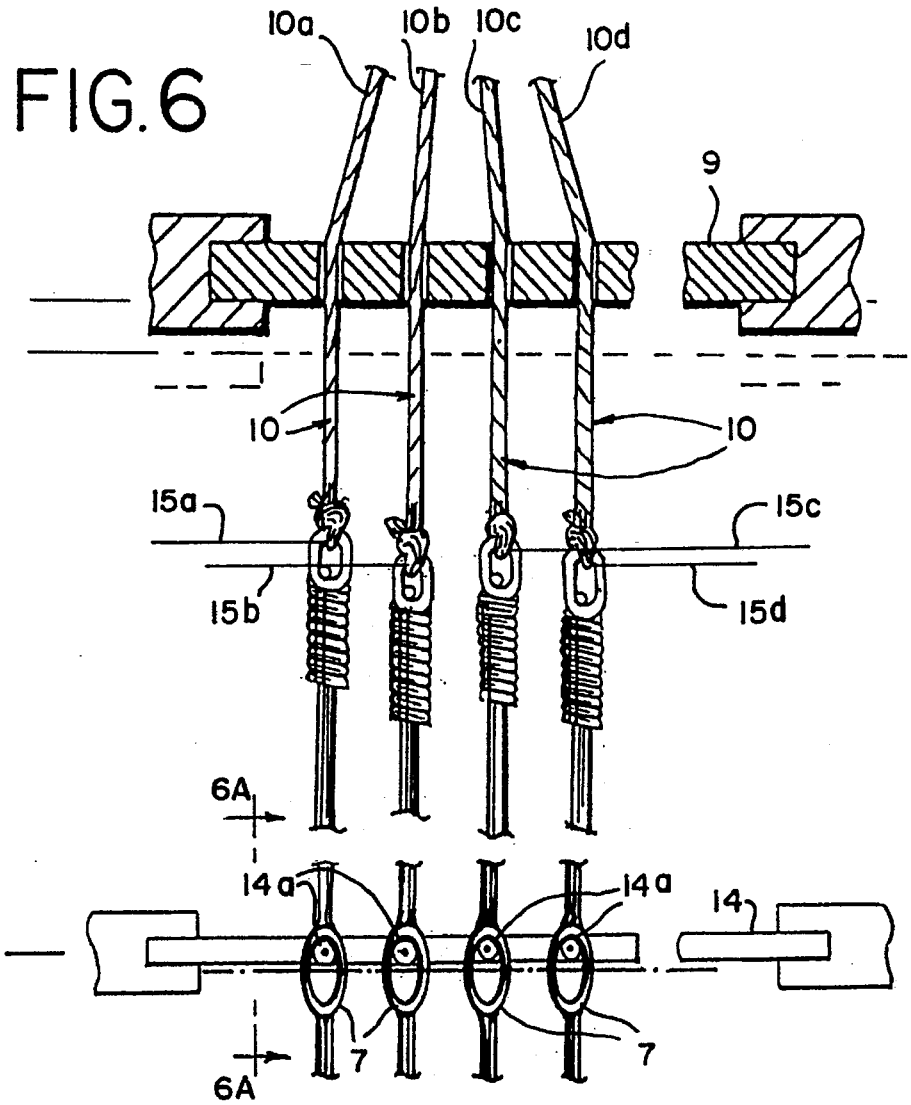
FIG. 6 is a fragmentary enlarged elevational view similar to FIG. 2 illustrating alternate means including spindles for maintaining eyes of the harness cord assemblies at a common level.
Figure 6A:
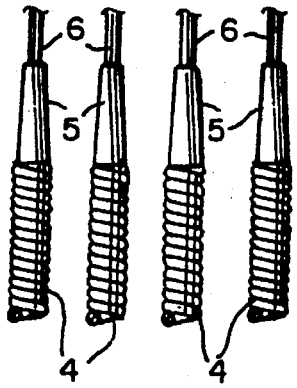
FIG. 6A is a fragmentary cross-sectional view taken substantially along lines 6A—6A of FIG. 6.
Figure 6A:
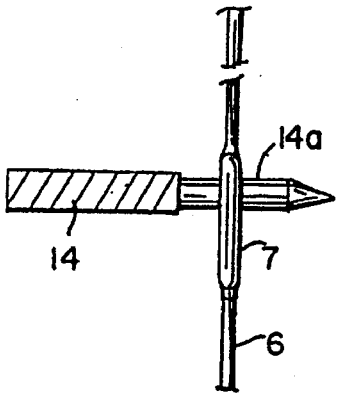

Referring to FIGS. 6 and 6A, the mandrel 14 may also be provided with a plurality of spaced apart spindles 14*a* along the length thereof for engaging the eyes 7 to maintain the eyes at a common level during the equilization process of the direct method. It should also be noted that the connecting portions 8 are not required to be at the same level as indicated by the lines 15*a*, 15*b*, 15*c* and 15*d* in this direct method. The comber board 9 does not have to be moved out of the normal operating position during assembly of the loom harness.

Figure 3:
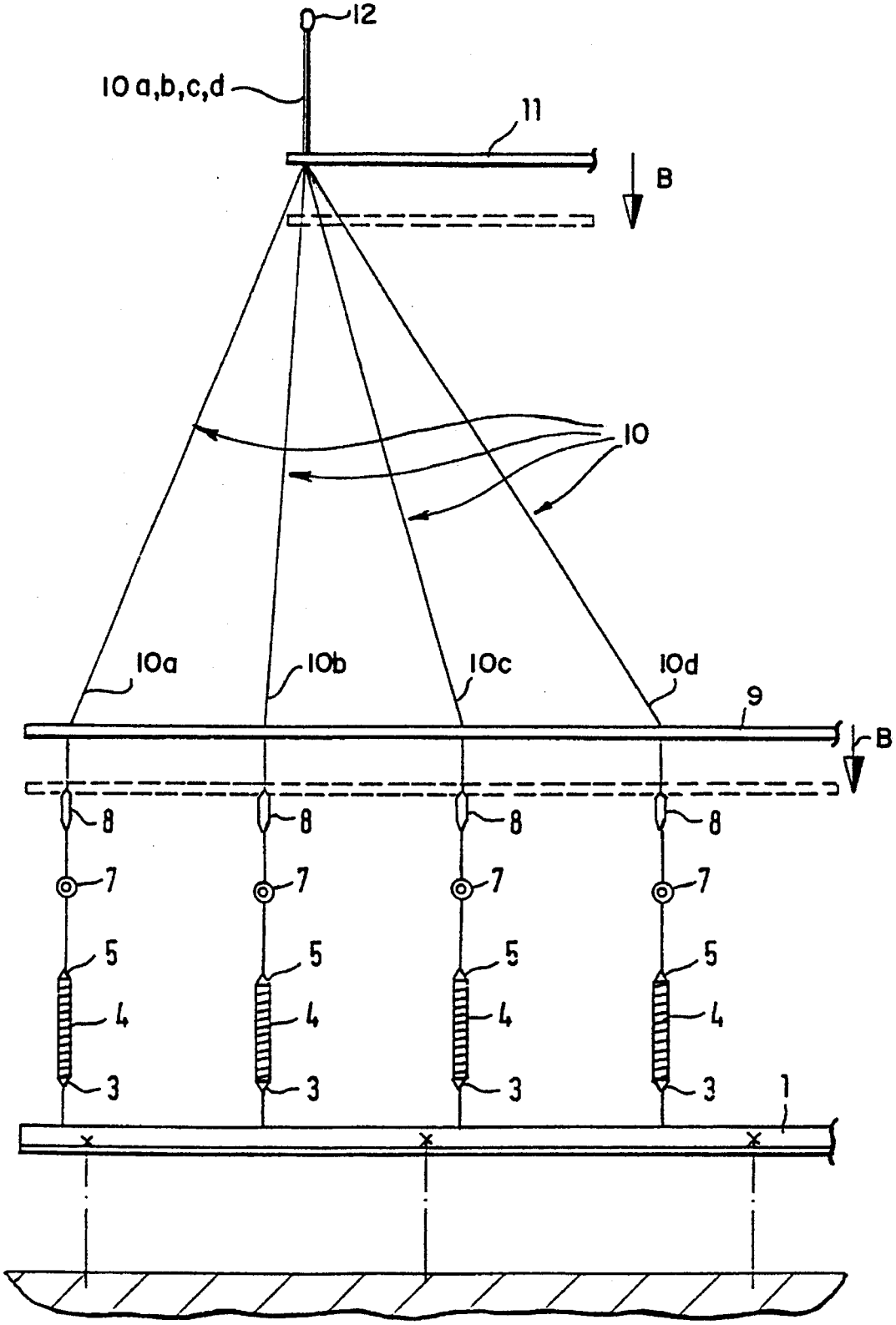
FIG. 3 is a diagrammatic front view of a loom harness as shown in FIG. 2, illustrating in dotted lines a respective aperture board and a comber board after movement from the normal operating position into an assembly position while assembly of the loom harness and equalization and tautness of the harness cords is completed.

Referring to FIG. 3, in an alternate embodiment, the mails 7 of each harness subassembly 10 are maintained at a common level during the equalization process by engagement of the connectors 8 or thickened portions against the underside of the comber board 9. The thickened portions 8 are too thick to pass through the holes in the comber board 9 which is lowered from the normal operating position as shown in solid lines to an assembly position shown in dotted lines. In this process the comber board 9 serves as a stop during the equalization process acting in conjunction with the thickened portions 8 when the harness cords 10*a*, 10*b*, 10*c*, 10*d*, etc. are bundled together passed through the single aperture of the board 11 and thereafter drawn to the proper tautness and secured to the connector 12 as previously described.

When the comber board 9 is lowered to the assembly position, the aperture board 11 is also lowered the same amount to maintain the same angular relationship during assembly between the individual harness cords 10*a*, 10*b*, 10*c*, 10*d* that obtains when the comber board 9 is in the normal operating position. This angular relationship between individual harness cords is continuously maintained during loom operation after assembly has been completed and the board 9 and 11 have been returned upwardly to the normal operating position. It is necessary that the connecting thickening elements 8 (which also serve as stops) to be the same spacing distance from the respective mails 7 on all of the healds 6. The operation of fixing the mails on a mandrel 14 (FIGS. 1–2) or like holding members to secure the same height during the equalization process is omitted when the later assembly method is followed.

Figure 5A:
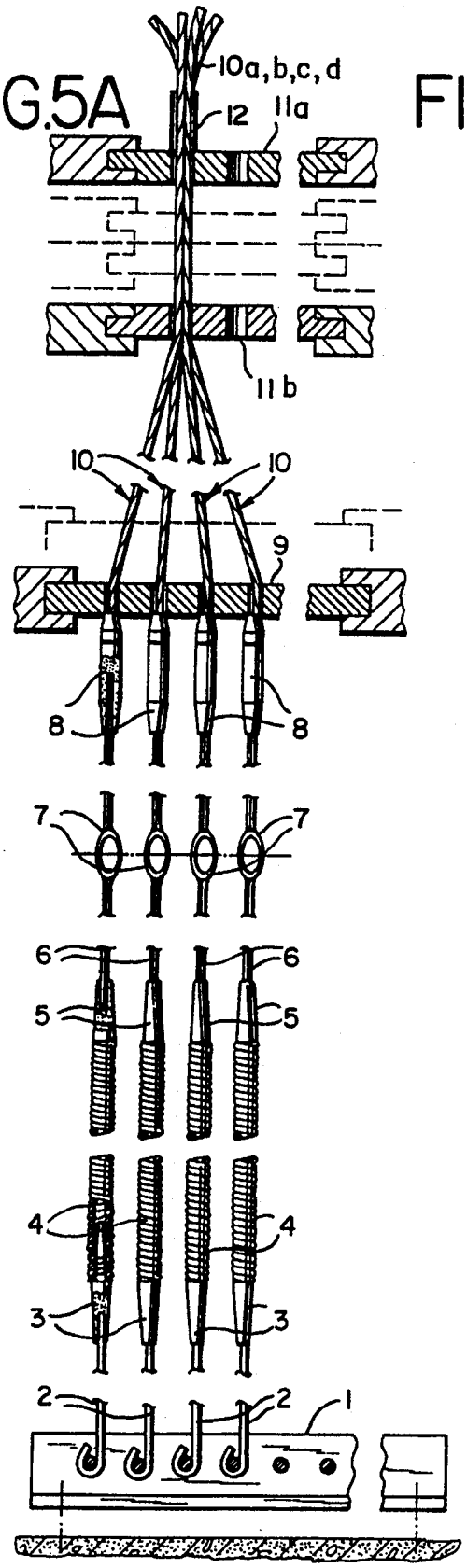
FIG. 5A is a fragmentary enlarged elevational view similar to FIG. 2 of another embodiment of a harness cord assembly made in accordance with the process of the present invention illustrating a two part aperture board and a comber board in an assembly position, and a normal operating position is indicated in dotted lines.
Figure 5B:
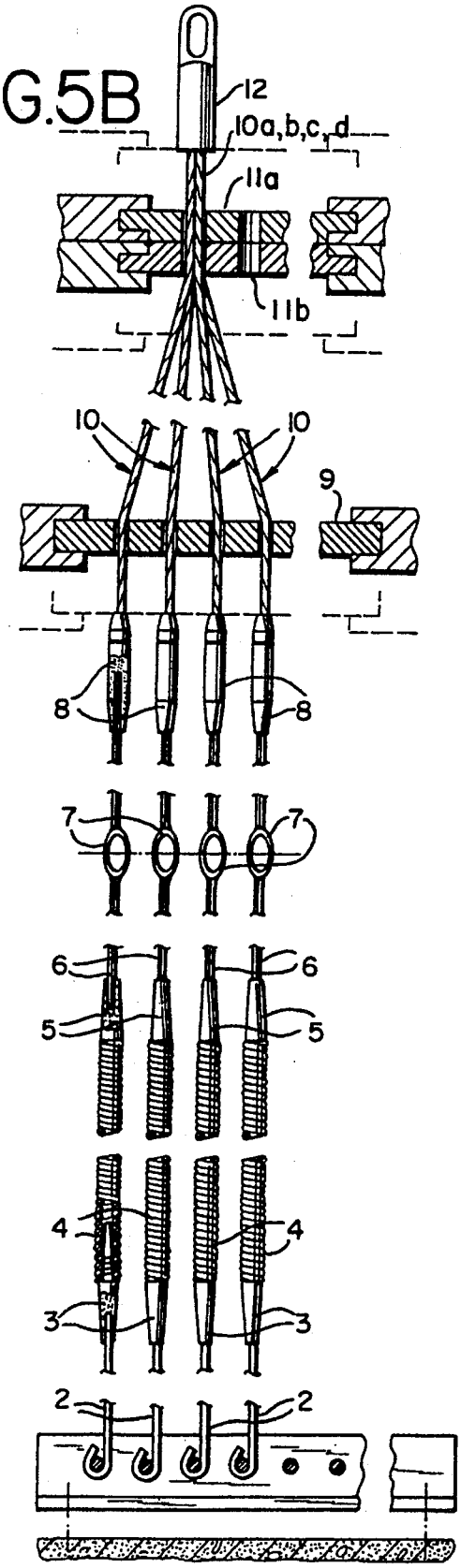
FIG. 5B is a fragmentary enlarged elevational view similar to FIG. 5*a* illustrating the loom harness thereof in a normal operating position and an assembly position is indicated in dotted lines.

Referring to FIGS. 5A and 5B, the upper aperture board is formed in two parts 11*a* and 11*b* which permits the top part 11*a* to be moved upwardly (FIG. 5A) to serve as a stop against the connector 12 to facilitate securing the connector in position holding the harness cords 10*a*, 10*b*, 10*c*, 10*d* etc. tightly together.

It will be appreciated that the above-described process, according to the invention, involves advantages inter alia that prefabrication of a subassembly is taken to a greater extent than in the prior, equalization can be more exact and precise and is simpler to perform. Moreover, during an operation, the subassemblies are worked in one direction only, i.e., from one side toward the other, more specifically, in an upward direction from the fixed frame member 1. Further advantages lie in the variation of the positions of the comber board 9 and the aperture board 11 or parts thereof, in relation to the end or final position in the loom.

The assembly position of the boards 9 and 11 during production of a loom harness assembly in accordance with the invention gives rise to a series of simplifications in terms of the manufacturing procedure. Consideration may be given in this respect in particular to the equalization operation in which it is possible to utilize connecting elements 8 as stops against the underside of the comber board 9. The assembly position of the aperture board 11 further affords major advantages as that board can serve as an aid or as a stop means in bringing or bundling together and securing the harness cords 10*a*, 10*b*, 10*c*, 10*d*, etc. for each connector 12 serving a respective carabiner hook or snap hook 13.

Apparatus for making the loom harness can be moved during the manufacturing procedure into any position depending on the requirements involved, so that the apparatus can be turned upside down 180°.

It will be appreciated that the above-described procedures have been set forth solely by way of example and illustration of the principles of the present invention and that various modifications and alterations may be made therein without thereby departing from the spirit and scope of the present invention.

While the invention has been described with reference to details of the illustrated embodiments, these details are not intended to limit the scope of the invention as defined in the appended claims.

I claim:

1. A method of making a loom harness interconnected between a base element and a spaced apart, moveable upper element of a loom, comprising the steps of:

prefabricating a plurality of subassemblies, each prefabricated subassembly including a flexible harness cord having first and second ends, a heald having first and second ends, and an eye in said heald and a counterpull having first and second ends, with said first end of said flexible harness cord being connected to said second end of said heald and said first end of said heald connected to said second end of said counterpull;

connecting said first end of each counterpull to a base loom element; then passing said second end of each of said harness cords through a different one of a plurality of openings provided at spaced apart intervals in a comber board positioned between said base element and a spaced apart, moveable upper loom element;

passing said second ends of said harness cords through a single aperture provided in an aperture board positioned between said comber board and the other of said moveable upper loom element; and bundling together said harness cords and connecting said second ends of said bundled harness cords to said moveable upper loom element while said eyes of said subassemblies are aligned with one another and while said cords are held taut.

2. The method of claim 1, wherein:

said spaced apart, moveable upper element of the loom includes a movable Jacquard member; and wherein said eyes are aligned with one another by mounting the eyes on equalization means.

3. The method of claim 1, wherein: said first end of each harness cord is connected to the second end of its respective heald by joining said first end of each harness cord to a connector and said second end of each heald to said connector, wherein each connector has a diameter greater than that of the openings in said comber board, and wherein the eyes are aligned with one another by lowering said comber board in an assembly position such that said connectors bear against said comber board at said openings, thereby serving as stops.

4. The method of claim 3, including spacing each connector from a respective eye by an equal distance.

5. The method of claim 1, wherein:

said step of passing said harness cords through said plurality of openings in said comber board and through said aperture in said aperture board includes the step of moving both said aperture board and comber board to an assembly position away from a normal operating position, and then passing said cords through said openings and aperture while said comber board and aperture board are in said assembly position.

6. The method of claim 5, wherein:

said step of moving both said aperture board and said comber board includes the step of maintaining said aperture board and said comber board a constant distance apart in said assembly position.

7. The method of claim 1, wherein said step of bundling together said cords includes the step of gathering together said second ends of said cords after they have passed through said aperture board, and said steps of connecting said cords to said movable upper loom element includes connecting said cords to a single lift means.

* * * * *